US010916168B2

(12) United States Patent
Lin

(10) Patent No.: US 10,916,168 B2
(45) Date of Patent: Feb. 9, 2021

(54) PANEL AND PIXEL STRUCTURE THEREOF

(71) Applicant: HannsTouch Solution Incorporated, Tainan (TW)

(72) Inventor: Sheng-Chia Lin, Tainan (TW)

(73) Assignee: HannsTouch Solution Incorporated, Tainan (TW)

( * ) Notice: Subject to any disclaimer, the term of this patent is extended or adjusted under 35 U.S.C. 154(b) by 0 days.

(21) Appl. No.: 16/421,489

(22) Filed: May 24, 2019

(65) Prior Publication Data

US 2020/0372847 A1 Nov. 26, 2020

(51) Int. Cl.
*G09G 3/20* (2006.01)

(52) U.S. Cl.
CPC ..... *G09G 3/20* (2013.01); *G09G 2300/0426* (2013.01); *G09G 2300/0439* (2013.01); *G09G 2300/0809* (2013.01); *G09G 2310/0278* (2013.01)

(58) Field of Classification Search
CPC ... G09G 2300/0426; G09G 2300/0439; G09G 2300/0809; G09G 2310/0278; G09G 3/20
USPC ..... 345/90–110
See application file for complete search history.

(56) References Cited

U.S. PATENT DOCUMENTS

2002/0070382 A1* 6/2002 Yamazaki ..... H01L 27/124 257/72
2003/0227591 A1* 12/2003 Liu ..... G02F 1/134336 349/143
2006/0232728 A1* 10/2006 Kim ..... G02F 1/1333 349/106
2013/0077010 A1* 3/2013 Takeda ..... G02F 1/1368 349/43
2014/0036214 A1* 2/2014 Hirosawa ..... G02F 1/134363 349/123
2015/0227004 A1* 8/2015 Cho ..... G02F 1/133707 349/41
2017/0045794 A1* 2/2017 Lin ..... H01L 27/1218
2017/0299926 A1* 10/2017 Takeda ..... G02F 1/133514
2018/0157135 A1* 6/2018 Wang ..... G02F 1/134309
2018/0197925 A1* 7/2018 Lius ..... H01L 27/3276
2019/0033493 A1* 1/2019 Kwon ..... B32B 27/36

* cited by examiner

*Primary Examiner* — Tony O Davis
(74) *Attorney, Agent, or Firm* — Winston Hsu

(57) ABSTRACT

A panel and a pixel structure are disclosed and include a substrate, a scan line, a data line, and a pixel electrode. The scan line is disposed on the substrate and extends along a first direction. The data line is disposed on the substrate and extends along a second direction different from the first direction. The pixel electrode is disposed on the substrate, in which the scan line and/or the data line crosses the pixel electrode.

9 Claims, 7 Drawing Sheets

PANEL AND PIXEL STRUCTURE THEREOF

BACKGROUND OF THE INVENTION

1. Field of the Invention

The present invention relates to a panel and a pixel structure thereof, and more particularly, to a panel with lowered parasitic capacitance and a pixel structure thereof.

2. Description of the Prior Art

The pixel structure is generally applied to a display panel to display an image. With the increasing demand for image resolution, the size of pixel structure needs to be continuously reduced, which makes the parasitic capacitance in the pixel structure have more obvious influence on the design of pixel structure. In order to reduce parasitic capacitance, the fill factor of the pixel structure, i.e. the ratio of the area of the pixel electrode to the area of the pixel region, thus decreases.

Refer to FIG. 1, which schematically illustrates a top view of a conventional pixel structure. As shown in FIG. 1, the conventional pixel structure 10 is defined as a structure in the pixel region PR, which includes a scan line 12 and a data line 14 respectively disposed on two adjacent sides of the pixel electrode 16. Thus, the parasitic capacitors are generated not only between the pixel electrode 16 and the data line 14 of the pixel structure 10 but also between the pixel electrode 16 of the pixel structure 10 and the data line 14 of the adjacent pixel structure (located on the right side of the pixel electrode 16). Accordingly, while reducing the size of the pixel structure 10 as much as possible, the voltage on the pixel electrode 16 is easily affected by the two data lines 14 and similarly easily affected by the two adjacent scan lines 12, so that the pixel structure 10 cannot operate normally. In addition, since the scan line 12 and the data line 14 cross each other, a parasitic capacitor 18 is also generated between them. In addition to the parasitic capacitance of the thin film transistor 20 of the conventional pixel structure 10, the influence of the total parasitic capacitance on the capacitance-resistance loading effect of the conventional pixel structure 10 while reducing the size is more obvious, such that the fill factor of the pixel structure 10 cannot be maintained or improved.

As a result, improving the fill factor of the pixel structure and reducing its parasitic capacitance are the objectives in the related art.

SUMMARY OF THE INVENTION

An embodiment of the present invention discloses a pixel structure including a substrate, a scan line, a data line, and a pixel electrode. The scan line is disposed on the substrate and extends along a first direction, the data line is disposed on the substrate and extends along a second direction different from the first direction, and the pixel electrode is disposed on the substrate, in which the scan line and/or the data line cross the pixel electrode.

An embodiment of the present invention discloses a panel including a substrate, a plurality of scan lines, a plurality of data lines, and a plurality of pixel electrodes. The scan lines are disposed on the substrate and extend along a first direction. The data lines are disposed on the substrate and extend along a second direction different from the first direction, and the data lines cross the scan lines. The pixel electrodes are disposed on the substrate, in which one of the scan lines and/or one of the data lines cross one of the pixel electrodes.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
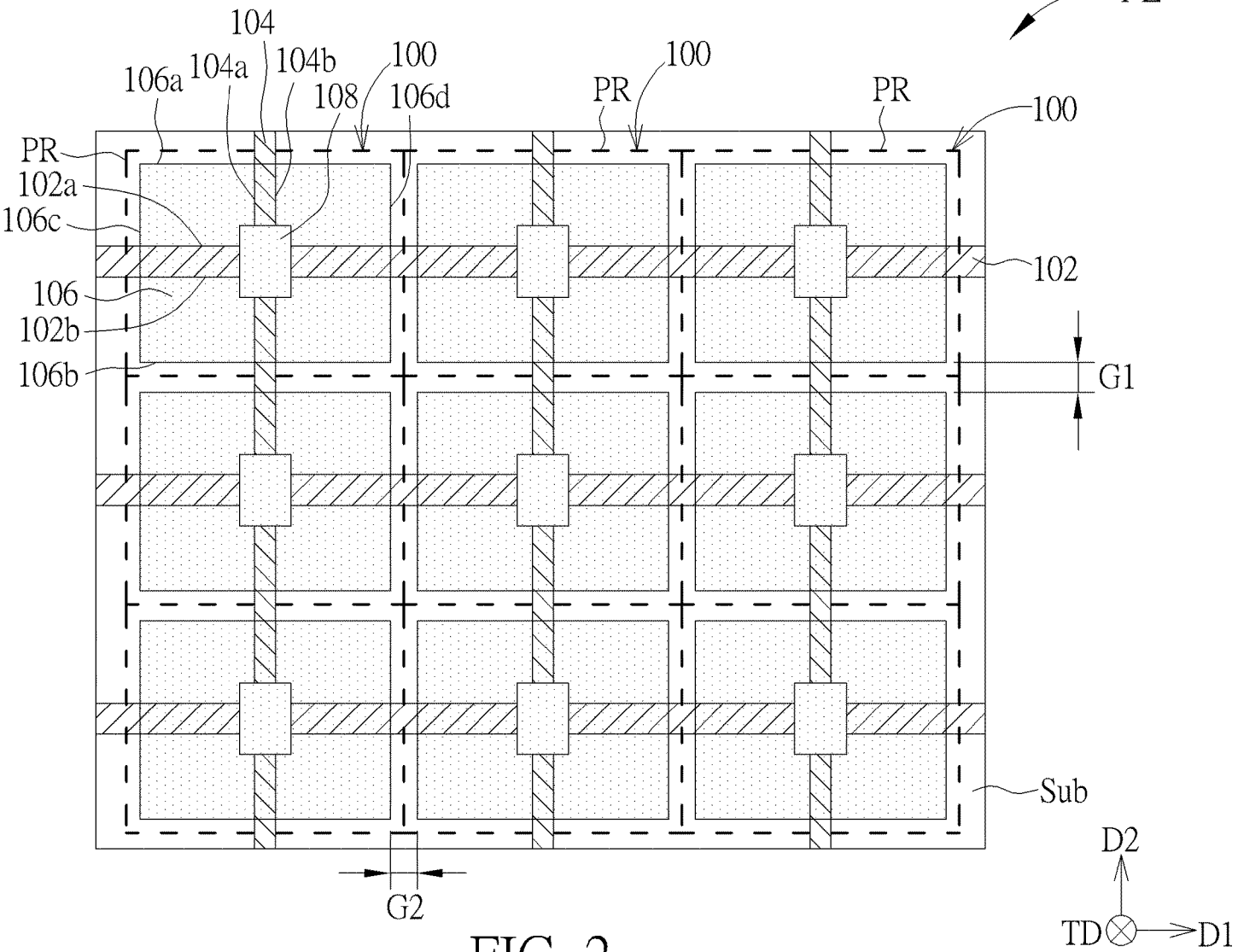
FIG. 2 schematically illustrates a top view of a panel according to an embodiment of the present invention.

Refer to FIG. 2, which schematically illustrates a top view of a panel according to an embodiment of the present invention. The panel PL of this embodiment includes a plurality of pixel structures 100 corresponding to pixels or sub-pixels of an image respectively. For example, each pixel structure 100 may be used for showing a pixel or a sub-pixel of single color of the image or for detecting a pixel or sub-pixel of the received image. Specifically, the panel PL has a plurality of pixel regions PR, each of which defining a region of one pixel structure 100. In this embodiment, the adjacent pixel regions PR have no spacing therebetween, i.e. the edges of the adjacent pixel regions PR are aligned with each other, such that one pixel region PR can represent a size of single one pixel structure 100. In this embodiment, the pixel regions PR are arranged in an array, but not limited thereto.

For clarity, FIG. 2 only illustrates a scan line 102, a data line 104, a pixel electrode 106, and a thin-film transistor 108 of the pixel structures 100, but not limited thereto. As shown in FIG. 2, the panel PL includes a substrate Sub, a plurality of scan lines 102 disposed on the substrate Sub and extending along a first direction D1, a plurality of data lines 104 disposed on the substrate Sub and extending along a second direction D2 different from the first direction D1, and a plurality of pixel electrodes 106 disposed on the substrate Sub, in which a structure of the panel PL in one of the pixel regions PR can be a single pixel structure 100. In this embodiment, the single pixel structure 100 may include a part of one of the scan lines 102, a part of one of the data lines 104, one of the pixel electrodes 106, and a thin-film transistor 108, in which the scan line 102 and the data line 104 in the pixel structure 100 cross each other and are insulated from each other, and the scan line 102 and/or the data line 104 crosses the pixel electrode 106. In this embodiment, the first direction D1 may be identical to a row direction of the pixel regions PR, and the second direction D2 may be identical to a column direction of the pixel regions PR, so the scan line 102 may cross the pixel regions PR of a same row, and the data line 104 may cross the pixel regions PR of a same column, but not limited thereto. In some embodiments, the scan line 102 may cross the pixel regions PR of the same column, and the data line 104 may cross the pixel regions PR of the same row. The first direction D1 may be for example perpendicular to the second direction D2, but not limited thereto.

In this embodiment, the scan line 102 and the data line 104 may cross the pixel electrode 106. As used herein, the scan line 102 "crosses" the pixel electrode 106 means that in the second direction D2, two sides 102*a*, 102*b* of the scan line 102 are disposed between two opposite sides 106*a*, 106*b* of the pixel electrode 106, the side 102*a* of the scan line 102 is aligned with the side 106*a* of the pixel electrode 106 while the side 102*b* of the scan line 102 is between the sides 106*a*, 106*b* of the pixel electrode 106, or the side 102*b* of the scan line 102 is aligned with the side 106*b* of the pixel electrode 106 while the side 102*a* of the scan line 102 is between the sides 106*a*, 106*b* of the pixel electrode 106, and in the first direction D1, two ends of the scan line 102 are respectively beyond the other two opposite sides 106*c*, 106*d* of the pixel electrode 106. As used herein, the data line 104 "crosses" the pixel electrode 106 means that in the second direction D2, two sides 104*a*, 104*b* of the data line 104 are disposed between two opposite sides 106*c*, 106*d* of the pixel electrode 106, the side 104*a* of the data line 104 is aligned with the side 106*c* of the pixel electrode 106 while the side 104*b* of the data line 104 is between the sides 106*c*, 106*d* of the pixel electrode 106, or the side 104*b* of the data line 104 is aligned with the side 106*b* of the pixel electrode 106 while the side 104*a* of the data line 104 is between the sides 106*c*, 106*d* of the pixel electrode 106, and in the first direction D1, two ends of the data line 104 respectively are beyond the other two opposite sides 106*a*, 106*b* of the pixel electrode 106. In other words, a part of the scan line 102 corresponding to the pixel electrode 106 may fully overlap the corresponding pixel electrode 106, while a part of the data line 104 corresponding to the pixel electrode may fully overlap the corresponding pixel electrode 106. The part of the scan line 102 corresponding to the pixel electrode 106 may be the part of the scan line 102 located between extension lines of the sides 106*c*, 106*d* of the corresponding pixel electrode 106 extending along the second direction D2, and the part of the data line 104 corresponding to the pixel electrode 106 may be the part of the data line 104 between extension lines of the sides 106*a*, 106*b* of the corresponding pixel electrode 106 extending along the first direction D1. It is noted that through the crossing of the scan line 102 and the pixel electrode 106 and the crossing of the data line 104 and the pixel electrode 106, parasitic capacitances of the pixel electrode corresponding to the scan line 102 and the data line 104 can be effectively reduced, such that the sides 106*a*, 106*b*, 106*c*, 106*d* of the pixel electrode 106 may be adjusted to be close to the edges of the single pixel structure (edges of the pixel region PR) respectively, i.e., the spacing G1 or spacing G2 between the pixel electrodes 106 is reduced, thereby increasing the area of the pixel electrode 106 and raising the fill factor of the pixel structure 100. The fill factor is a ratio of the area of the pixel electrode 106 to the area of the pixel region PR. Specific effect is detailed in the following example. In some embodiments, in the top view direction TD, the pixel electrode 106 may cover the overlapping part of the san line 102 and the data line 104 (i.e. crossing part).

In some embodiments, when the panel PL is an opaque display panel, such as an electronic paper, an organic light emitting diode display panel, a micro-sized or small-sized light emitting diode display panel, or an X-ray sensing panel, the pixel electrode 106 may include an opaque conductive material, such as metal. Since the scan line 102 and the data line 104 of this embodiment cross the pixel electrode 106, the panel PL is preferably an opaque panel so as to prevent the scan line 102 and the data line 104 crossing the pixel electrode 106 from affecting the light transmittance of the pixel structure 100. In some embodiments, the panel PL may also be a transparent display panel, such as a liquid crystal display panel, the pixel electrode 106 may include a transparent conductive material, such as indium tin oxide. In some embodiments, according to the type of the panel to which the pixel structure 100 is applied, other components may be optionally formed on the pixel electrode 106, such as, but not limited to, an organic light emitting layer and an electrode layer of the organic light emitting diode display panel, a photo detector and a scintillation detector of the X-ray sensing panel, or an inorganic light emitting diode of the light emitting diode display panel.

In this embodiment, the pixel electrode 106 can cover the corresponding thin film transistor 108 in the top view direction TD, i.e., the thin film transistor 108 completely overlaps the corresponding pixel electrode 106, and the thin film transistor 108 can be disposed at the crossing of the scan line 102 and the data line 104. For example, the thin film transistor 108 may include overlapping part of the scan line 102 and the data line 104, but not limited thereto. In some embodiments, the thin film transistor 108 may be disposed adjacent to the crossing of the scan line 102 and the data line 104. In some embodiments, the number of thin film transistors 108 may be one or more based on the type of the panel. In some embodiments, the thin film transistor 108 may partially overlap its corresponding pixel electrode 106 in the top view direction TD.

Figure 3:
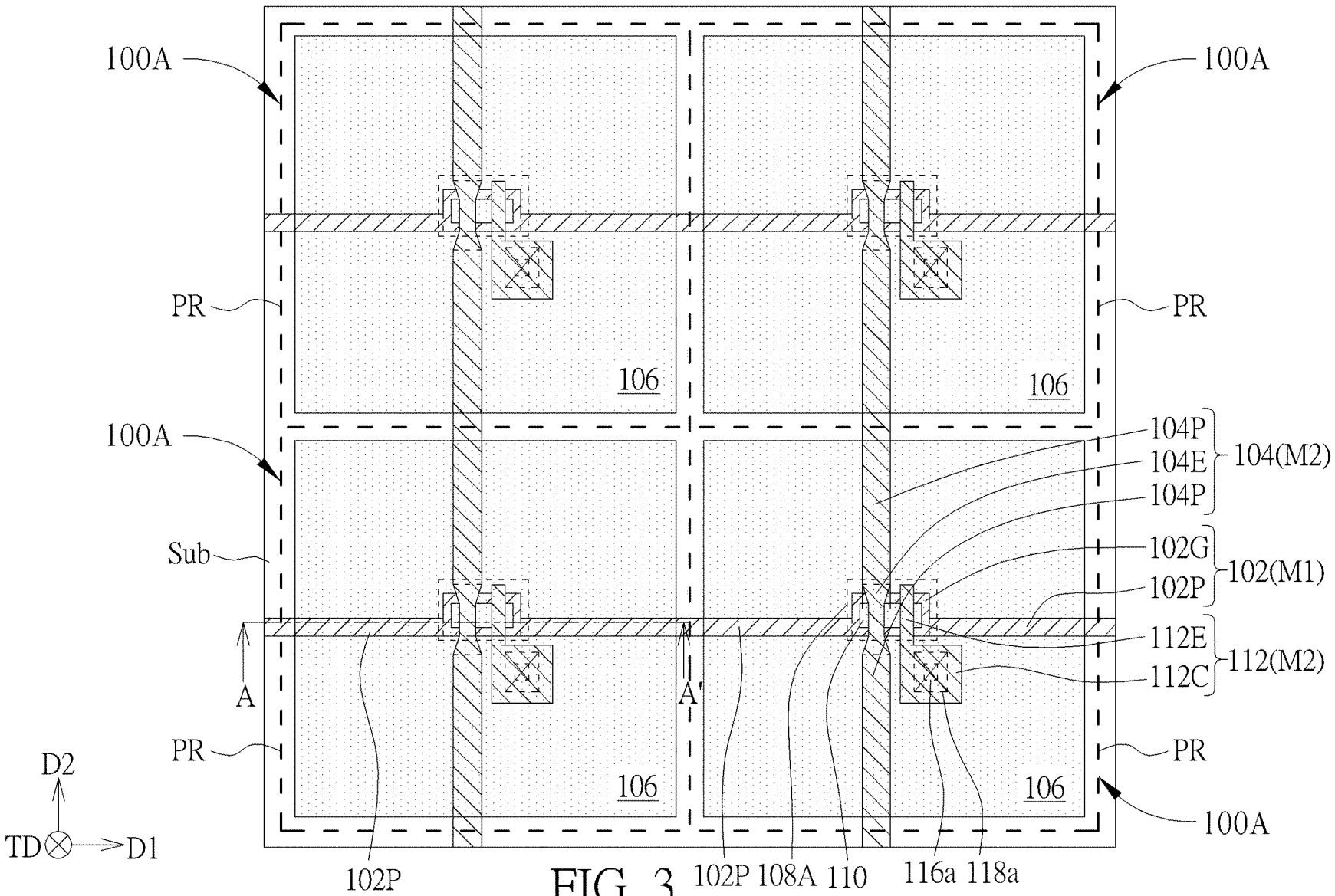
FIG. 3 schematically illustrates a top view of a pixel structure according to a first example of the first embodiment of the present invention.
Figure 4:
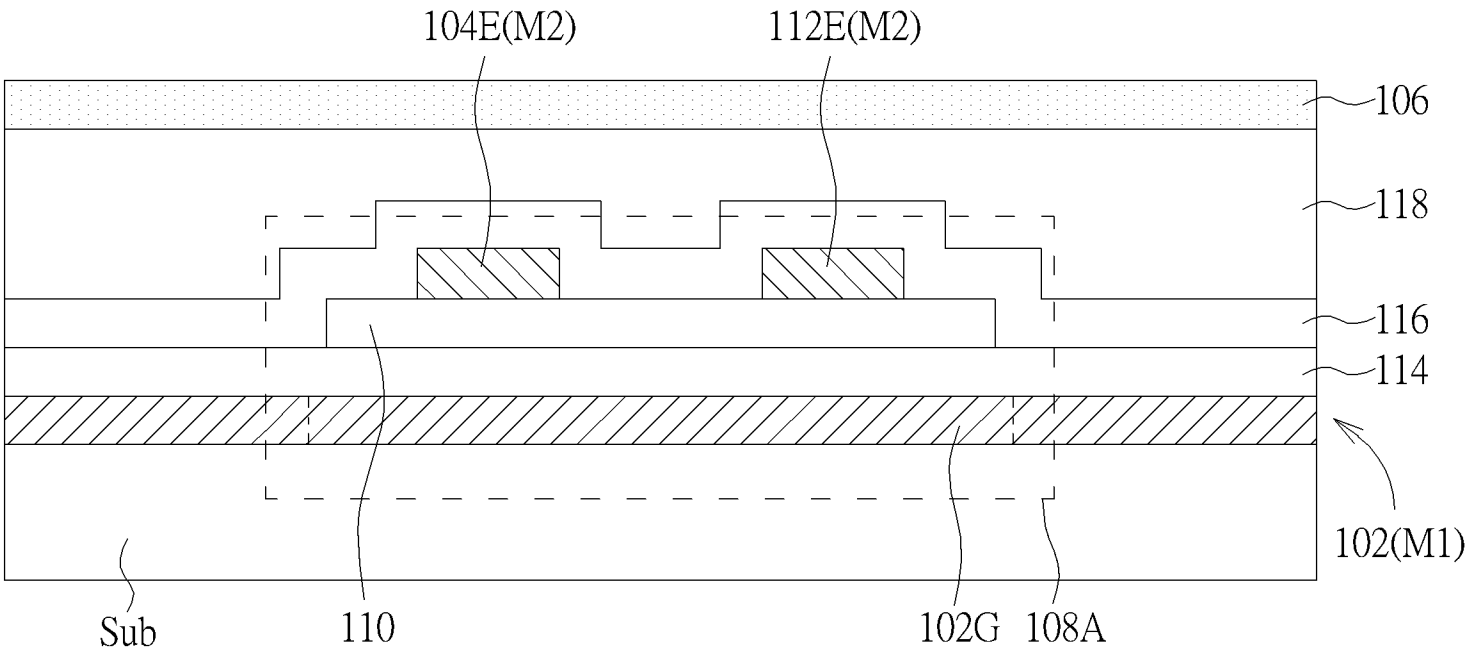
FIG. 4 schematically illustrates a sectional view of the pixel structure along a line A-A' of FIG. 3.

Refer specifically to FIGS. 3 and 4. FIG. 3 schematically illustrates a top view of a pixel structure according to a first example of the first embodiment of the present invention, and FIG. 4 schematically illustrates a sectional view of the pixel structure along a line A-A' of FIG. 3. As shown in FIGS. 3 and 4, in the pixel structure 100A of this example, the scan line 102 may have a gate portion 102G and a first segment portion 102P, in which the gate portion 102G serves as a gate of the thin film transistor 108A, and the first segment portion 102P is connected to the gate portion 102G so as to electrically connect the gate portions 102G of adjacent pixel structures 100A to each other. The scan line 102 of this example may have two first segment portions 102P, and the gate portion 102G is connected between the first segment portions 102P, but not limited thereto. In this example, the width of the gate portion 102G in the second direction D2 may be greater than the width of the first segment portion 102P in the second direction D2. In some embodiments, the width of the gate portion 102G may be less than or equal to the width of the first segment portion 102P according to actual design requirements. In addition, in this example, the data line 104 may have a first electrode portion 104E and two second segment portions 104P, and the first electrode portion 104E is connected between the second segment portions 104P. In this example, the width of the first electrode portion 104E in the first direction D1 may be smaller than the width of the second segment portion 104P in the first direction D1. In some embodiments, the width of the first electrode portion 104E may be greater than or equal to the width of the second segment portion 104P according to actual design requirements.

The pixel structure 100A may further include a semiconductor island 110 and an electrode 112. The semiconductor island 110 is disposed corresponding to the gate portion 102G of the scan line 102. The electrode 112 is disposed on one side of the first electrode portion 104E of the data line 104 and spaced apart from the first electrode portion 104E. The electrode 112 may have a second electrode portion 112E, and the second electrode portion 112E and the first electrode portion 104E cross the semiconductor island 110 and are electrically connected to two portions of the semiconductor island 110, respectively, so that the first electrode portion 104E and the second electrode portion 112E of this example may serve as the source and drain of the thin film transistor 108A, respectively. In some embodiments, the first electrode portion 104E and the second electrode portion 112E can also serve as the drain and source of the thin film transistor 108A, respectively. In this example, the overlapping part of the scan line 102 and the data line 104 is the overlapping part of the gate portion 102G and the first electrode portion 104E. In some embodiments, the overlapping part of the scan line 102 and the data line 104 may overlap the semiconductor island 110.

In this example, as shown in FIG. 4, the gate portion 102G of the scan line 102 is disposed between the substrate Sub and the semiconductor island 110, and the pixel structure 100A further includes a gate insulating layer 114 disposed between the scan line 102 and the semiconductor island 110 for electrically insulating the scan line 102 from the semiconductor island 110 and serving as the gate insulating layer of the thin film transistor 108A. The gate insulating layer 114 is also disposed between the scan line 102 and the data line 104 to electrically insulate the scan line 102 from the data line 104. In addition, the electrode 112 and the data line 104 are disposed on the semiconductor island 110 and the gate insulating layer 114. Thus, the second electrode portion 112E of the electrode 112, the semiconductor island 110, the gate insulating layer 114, the gate portion 102G of the scan line 102, and the first electrode portion 104E of the data line 104 may form the thin film transistor 108A. That is, the thin film transistor 108A of this example is a bottom gate type, but the present invention is not limited thereto. In this example, the second electrode portion 112E, the semiconductor island 110, the corresponding gate insulating layer 114, the gate portion 102G, and the first electrode portion 104E are all located directly under the pixel electrode 106, such that the pixel electrode 106 may cover the thin film transistor 108A. In this example, the scan line 102 may be formed of a first metal layer M1, and data line 104 and electrode 112 may be formed of a second metal layer M2, but not limited thereto. In some embodiments, the second metal layer M2 forming the electrode 112 and the data line 104 may also be disposed between the semiconductor island 110 and the gate insulating layer 114. The area of the gate portion 102G of this example may be greater than the area of the semiconductor island 110, but is not limited thereto. In some embodiments, the area of the semiconductor island 110 may be greater than the area of the gate portion 102G.

In addition, the electrode 112 may have a connecting portion 112C electrically connected to the pixel electrode 106. Specifically, the pixel structure 100A further includes an insulating layer 116 and a flat layer 118, which are sequentially formed to cover the thin film transistor 108A and the gate insulating layer 114, and the pixel electrode 106 is disposed on the flat layer 118. The insulating layer 116 may have a first opening 116*a*, and the flat layer 118 may have a second opening 118*a* corresponding to the first opening 116*a*, such that the pixel electrode 106 may be electrically connected to the connecting portion 112C of the electrode 112 through the first opening 116*a* and the second opening 118*a*. The insulating layer 116 may include, for example, an inorganic insulating material such as silicon oxide or silicon nitride, but not limited thereto. The flat layer 118 may include, for example, an organic insulating material, but not limited thereto. It is noted that compared to the conventional pixel structure, the pixel structure 100A of this example does not have an additional film layer, so no extra manufacturing cost is increased.

Figure 1:
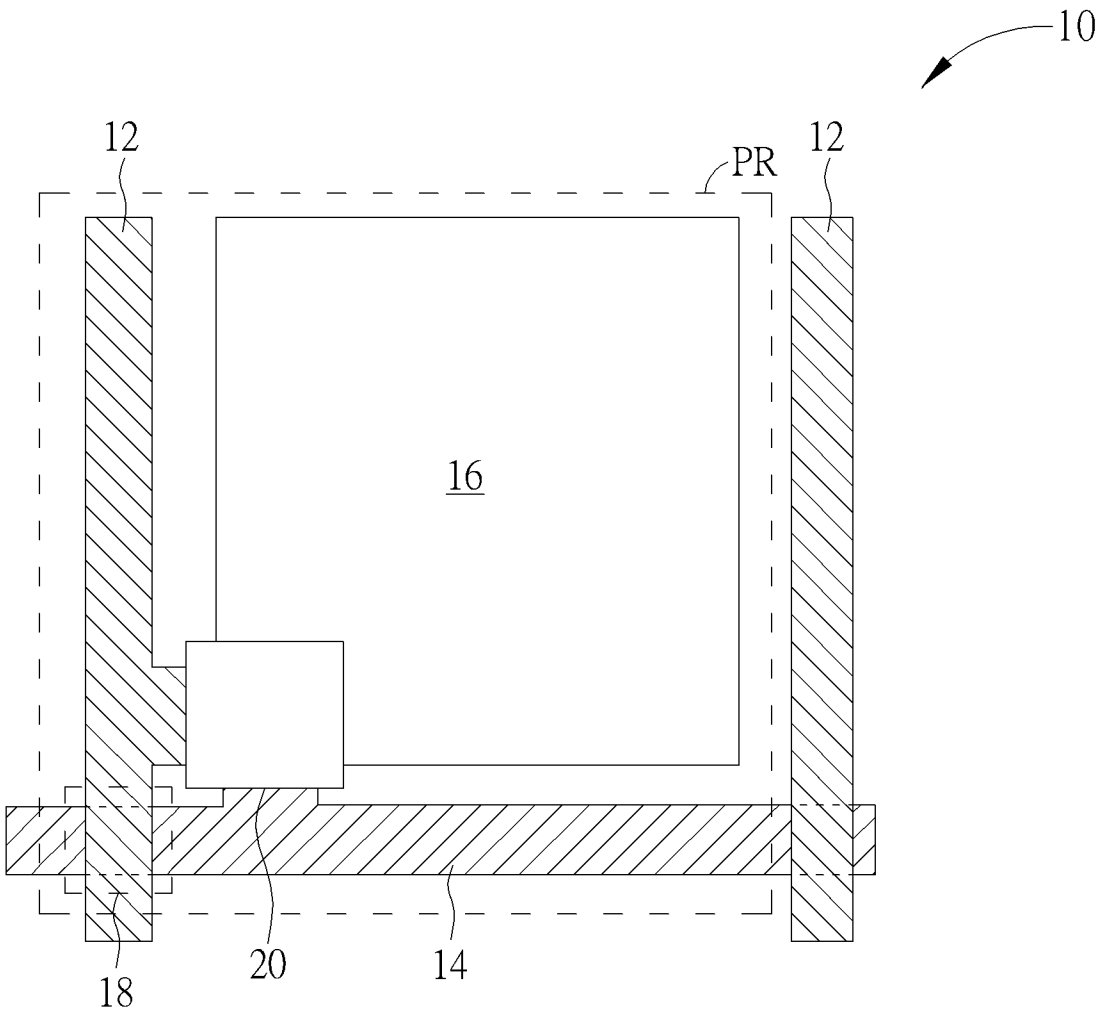
FIG. 1 PRIOR ART
FIG. 1 schematically illustrates a top view of a conventional pixel structure.

The difference in parasitic capacitance between the pixel structure of this example and the conventional pixel structure shown in FIG. 1 is further compared and detailed in the following description. Refer to Table 1, which compares the parasitic capacitance of the pixel structure 100A of this example with the parasitic capacitance of the conventional pixel structure under the same area of the pixel region. As shown in Table 1, as compared to the parasitic capacitance corresponding to the scan lines 12 of the conventional pixel structure 10, due to the crossing design of the scan line 102 and the pixel electrode 106 in this example, the parasitic capacitance corresponding to scan line 102 (i.e., the parasitic capacitance generated by the scan line 102) of this example can be reduced by 6.35% (i.e., a ratio of the difference between the two parasitic capacitances to the parasitic capacitance of the conventional pixel structure 10). In addition, since the overlapping part of the scan line 102 and the data line 104 is the overlapping part of the gate portion 102G and the first electrode portion 104E, the parasitic capacitance between the scan line 102 and the data line 104 is the gate-source capacitance of the thin film transistor 108A, thereby omitting the parasitic capacitance (such as the capacitance of parasitic capacitor 18 in FIG. 1) caused by the overlapping of the scan line 12 and the data line 14 outside the thin film transistor 20. Thus, the parasitic capacitance corresponding to the scan line 102 can be effectively reduced. In addition, as compared to the parasitic capacitance corresponding to the data line 14 in the conventional pixel structure 10, due to the crossing design of the data line 104 and the pixel electrode 106 in this example, the parasitic capacitance corresponding to the data line 104 (i.e., the parasitic capacitance generated by the data line 104) in this example can be reduced by 29.43% (i.e., a ratio of the difference between the two parasitic capacitances to the parasitic capacitance of the conventional pixel structure 10). Furthermore, because the scan line 102 and the data line 104 do not have parasitic capacitor (such as the parasitic capacitor 18 in FIG. 1) outside the thin film transistor, the parasitic capacitance corresponding to the data line 104 can be effectively reduced. For the reason mentioned above, the parasitic capacitances corresponding to the scan line 102 and corresponding to the data line 104 in this example can be greatly reduced. Preferably, the pixel electrode 106 may cover the overlapping part (i.e., crossing part) of the scan line 102 and the data line 104 in the top view direction TD. More preferably, the pixel electrode 106 may cover the thin film transistor 108 in the top view direction TD.

TABLE 1

| | gate-source capacitance (fF) | gate-drain capacitance (pF) | parasitic capacitance corresponding to the scan line (pF) | parasitic capacitance corresponding to the data line (pF) |
|---|---|---|---|---|
| Conventional pixel structure | 28.7 | 27.33 | 130.76 | 28.23 |
| Pixel structure of this example | 31.41 | 21.06 | 122.45 | 19.92 |

Please refer to FIG. 2 again. It should be noted that since the parasitic capacitance corresponding to the scan line 102 in this example can be reduced, and the scan line 102 crosses the pixel electrode 106, a spacing G1 between adjacent pixel electrodes 106 in the same column can be reduced without being affected by the scan line 102. For example, the spacing G1 between two adjacent pixel electrodes 106 arranged along the second direction D2 may be less than the width of the scan line 102. Similarly, a spacing G2 between adjacent pixel electrodes 106 in the same row can be reduced without being affected by the data line 104. For example, the spacing G2 between two adjacent pixel electrodes 106 arranged along the first direction D1 is less than the width of the data line 104. The spacing G1 and the spacing G2 may, for example, be close to the process limit of patterning the conductive layer for forming the pixel electrode 106. For example, when the pixel electrode 106 is formed of the transparent conductive material, the spacing G1 and the spacing G2 may be, for example, close to 4 to 6 microns. When the pixel electrode 106 is formed of metal, the spacing G1 and the spacing G2 may be, for example, close to 2 to 4 microns. Thus, the fill factor (i.e., the ratio of the pixel electrode 106 to the pixel region PR) can be increased, for example, by about 14.5% (a ratio of the difference between the fill factors of this example and the conventional pixel structure to the fill factor of the conventional pixel structure). Moreover, if the parasitic capacitance corresponding to the scan line 102 of this example is designed to be the same as that of the conventional pixel structure, the width of the scan line 102 of this example can be further increased to reduce the equivalent resistance of the scan line 102. Similarly, the width of the data line 104 in this example can be further increased to reduce the equivalent resistance of the data line 104. Furthermore, if the total parasitic capacitance of the pixel structure 100A of this example is designed to be the same as that of the conventional pixel structure, the area of the pixel structure 100A of the panel PL of this example can be reduced to improve the resolution of the panel PL.

Figure 5:
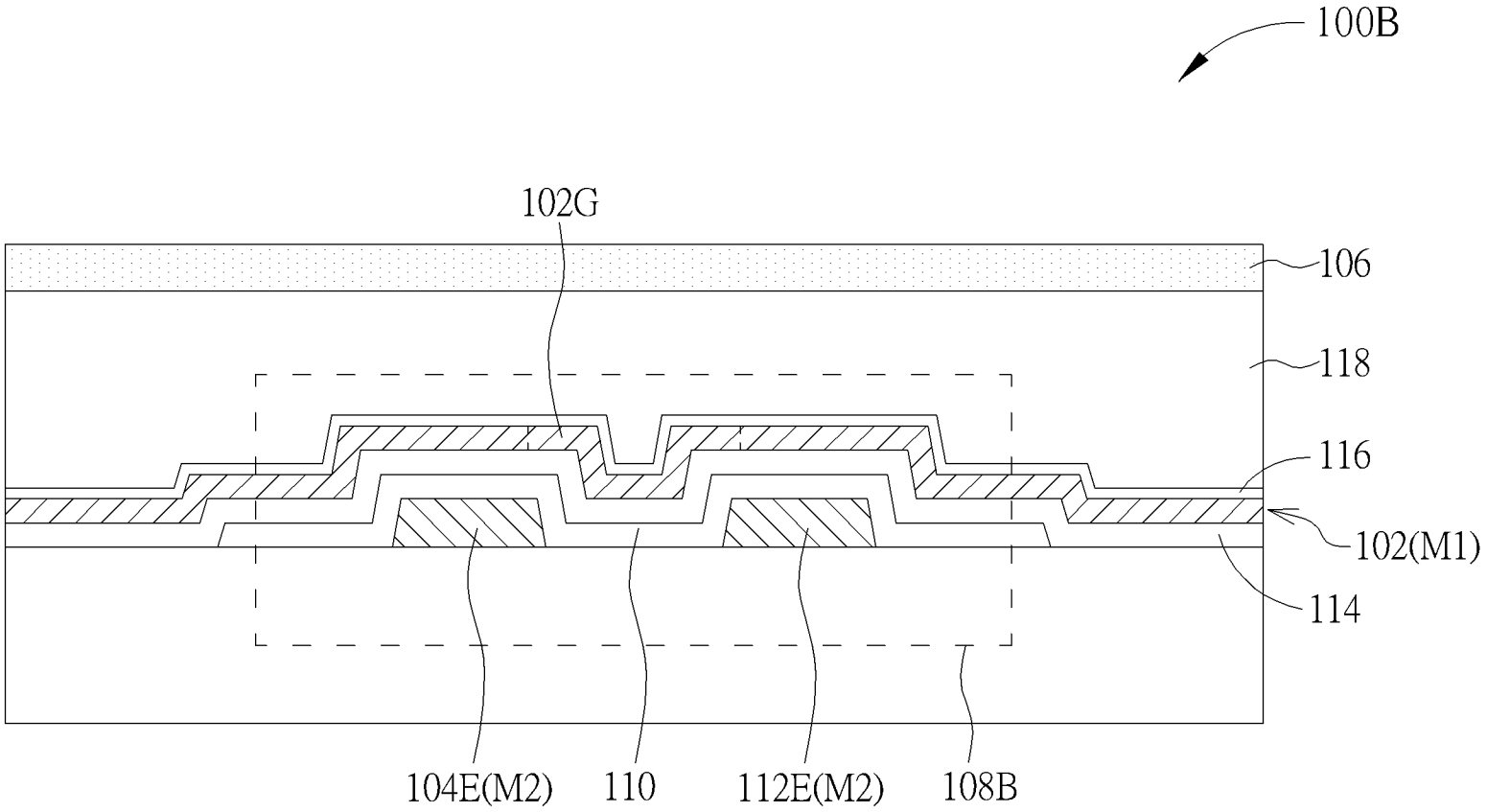
FIG. 5 schematically illustrates a sectional view of a pixel structure according to a second example of the first embodiment of the present invention.

Refer to FIG. 5, which schematically illustrates a sectional view of a pixel structure according to a second example of the first embodiment of the present invention. The schematic top view of the pixel structure 100B of the second example can be similar to that of FIG. 3, so the top view structure of the pixel structure 100B will not be described redundantly. As shown in FIG. 5, compared to the first example, the thin film transistor 108B of this example may be of a top gate type. Specifically, the semiconductor island 110 is disposed between the substrate Sub and the gate portion 102G of the scan line 102, and the gate insulating layer 114 is disposed between the semiconductor island 110 and the scan line 102. The second metal layer M2 forming the electrode 112 and the data line 104 may be located between the semiconductor island 110 and the substrate Sub. In some embodiments, the second metal layer M2 may also be located between the semiconductor island 110 and the gate insulating layer 114.

The pixel structure of the present invention is not limited to the above embodiment. Further variant embodiments and embodiments of the present invention are described below. To compare the embodiments conveniently and simplify the description, the same component would be labeled with the same symbol in the following. The following description will detail the dissimilarities among different embodiments and the identical features will not be redundantly described.

Figure 6:
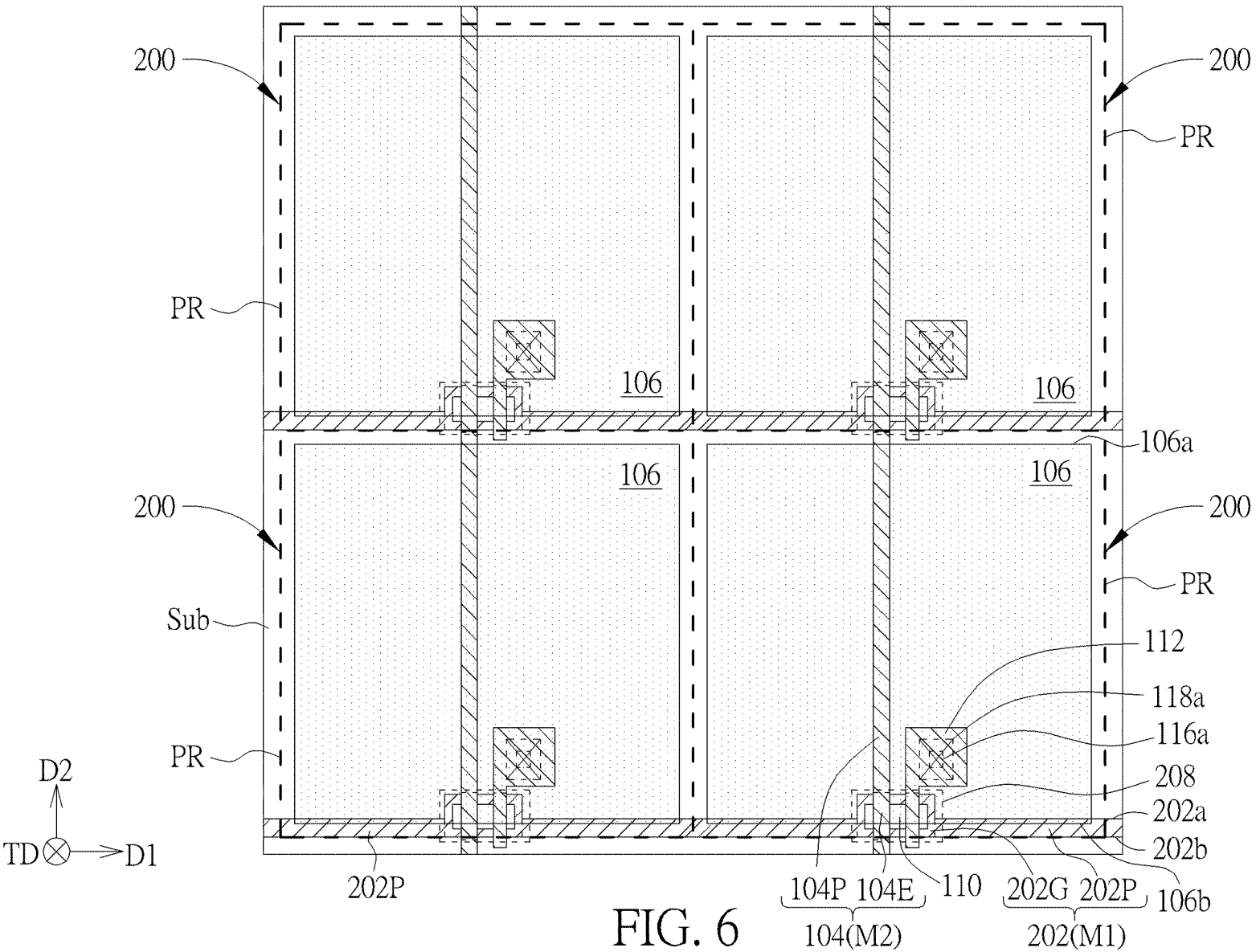
FIG. 6 schematically illustrates a top view of a pixel structure according to a second embodiment of the present invention.

Refer to FIG. 6, which schematically illustrates a top view of a pixel structure according to a second embodiment of the present invention. As shown in FIG. 6, compared to the first embodiment, the pixel electrode 106 of the pixel structure 200 provided in this embodiment may not cross the corresponding scan line 202 (i.e., their disposition are not the crossing as mentioned above), but a part of the scan line 202 corresponding to the pixel electrode 106 may partially overlap the pixel electrode 106, and the pixel electrode 106 may still cross the corresponding data line 104 (i.e., a part of the data line 104 corresponding to the pixel electrode 106 may completely overlap the pixel electrode 106). In this embodiment, the scan line 202 may overlap one side 106*b* of the corresponding pixel electrode 106, such that the side 106*b* of the pixel electrode 106 is located between the sides 202*a*, 202*b* of the scan line 202. That is, both the first segment portion 202P and the gate portion 202G of the scan line 202 may partially overlap the pixel electrode 106, so the thin film transistor 208 may partially overlap the pixel electrode 106. In some embodiments, the side 106*a* of the pixel electrode 106 may be located between the sides 202*a*, 202*b* of the scan line 202. In some embodiments, the first segment portion 202P of the scan line 202 may not overlap the pixel electrode 106, while the gate portion 202G may partially overlap the pixel electrode 106. In some embodiments, the scan line 202 may not overlap the pixel electrode 106, so that the thin film transistor 208 does not overlap the pixel electrode 106. In this embodiment, since the data line 104 crosses the pixel electrode 106, the coupling capacitance between the data line 104 and another adjacent pixel electrode 106 can be reduced. Accordingly, the spacing between the adjacent pixel electrodes 106 arranged along the first direction D1 can be reduced to improve the fill factor of the pixel structure 200.

Figure 7:
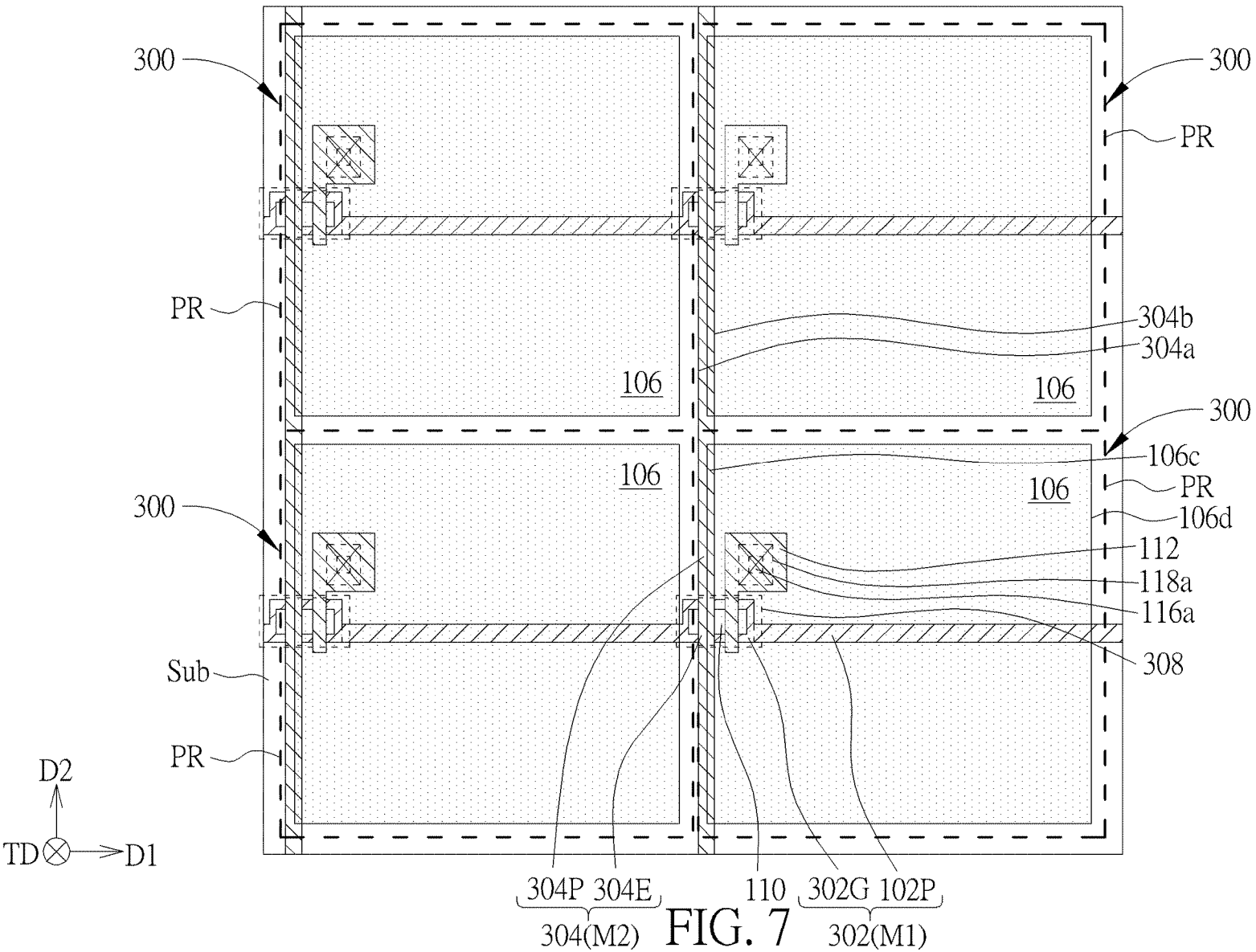
FIG. 7 schematically illustrating a top view of a pixel structure according to a third embodiment of the present invention.

Refer to FIG. 7, which schematically illustrating a top view of a pixel structure according to a third embodiment of the present invention. As shown in FIG. 7, compared to the first embodiment, the pixel electrode 106 of the pixel structure 300 provided in this embodiment may not cross its corresponding data line 304 (i.e., their disposition are not the crossing as mentioned above), but a part of the data line 304 corresponding to the pixel electrode 106 may partially overlap the pixel electrode 106, while the pixel electrode

106 may still cross its corresponding scan line 302 (i.e., a part of the scan line 302 corresponding to the pixel electrode 106 may completely overlap the pixel electrode 106). In this embodiment, the data line 304 may overlap one side 106*c* of the pixel electrode 106, such that the side 106*c* of the pixel electrode 106 is located between the sides 304*a*, 304*b* of the data line 304. That is, the second segment portion 304P and the first electrode portion 304E of the data line 304 may both partially overlap the pixel electrode 106, so the thin film transistor 308 may partially overlap the pixel electrode 106. In some embodiments, the side 106*d* of the pixel electrode 106 may be located between the sides 304*a*, 304*b* of the data line 304. The gate portion 302G of this embodiment may partially overlap the pixel electrode 106. In some embodiments, the data line 304 may not overlap the pixel electrode 106. In some embodiments, if the data line 304 does not overlap the pixel electrode 106, the thin film transistor 308 may not overlap the pixel electrode 106. In this embodiment, since the scan line 302 and the pixel electrode 106 cross each other, the coupling capacitance between the scan line 302 and the adjacent other pixel electrode 106 can be reduced, so that the spacing between the adjacent pixel electrodes 106 arranged along the second direction D2 can be reduced to improve the fill factor of the pixel structure 300.

In summary, in the panel and pixel structure of the present invention, the parasitic capacitance of the pixel structure can be effectively reduced by the crossing of the scan line and/or the data line with the pixel electrode, thereby improving the fill factor of the pixel structure. Therefore, when the size of the pixel structure is reduced, the fill factor of the pixel structure will not be limited.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel structure, comprising:

a substrate;

a scan line, disposed on the substrate and extending along a first direction;

a data line, disposed on the substrate and extending along a second direction different from the first direction;

a pixel electrode, disposed on the substrate, and at least one of the scan line and the data line crossing the pixel electrode;

a semiconductor island, disposed on the substrate;

a gate insulating layer, disposed between the semiconductor island and the scan line; and an electrode, electrically connected to the pixel electrode;

wherein the electrode, the semiconductor island, the gate insulating layer, a part of the scan line and a part of the data line form a thin-film transistor, the pixel electrode at least covers a part of the thin-film transistor.

2. The pixel structure according to claim 1, wherein the scan line crosses the pixel electrode, and the data line crosses the pixel electrode.

3. The pixel structure according to claim 1, wherein the scan line crosses the pixel electrode, and the data line overlaps a side of the pixel electrode.

4. The pixel structure according to claim 1, wherein the data line crosses the pixel electrode, and the data line overlaps a side of the pixel electrode.

5. The pixel structure according to claim 1, wherein a width of the part of the data line is less than a width of another part of the data line.

6. The pixel structure according to claim 1, wherein a width of the part of the scan line is greater than a width of another part of the scan line.

7. A panel, comprising:

a substrate;

a plurality of scan lines, disposed on the substrate and extending along a first direction;

a plurality of data lines, disposed on the substrate and extending along a second direction different from the first direction, and the data lines crossing the scan lines;

a plurality of pixel electrodes, disposed on the substrate, and at least one of one of the scan lines and one of the data lines crossing one of the pixel electrodes;

a plurality of semiconductor islands, disposed on the substrate;

a gate insulating layer, disposed between the semiconductor islands and the scan lines; and a plurality of electrodes, wherein one of the electrodes is electrically connected to the one of the pixel electrodes;

wherein the one of the electrodes, one of the semiconductor islands, a part of the gate insulating layer, a part of the one of the scan lines and a part of the one of the data lines form a thin-film transistor, the one of the pixel electrodes at least covers a part of the thin-film transistor.

8. The panel according to claim 7, wherein a spacing between two of the pixel electrodes adjacent to each other and arranged along the first direction is less than a width of the one of the data lines.

9. The panel according to claim 7, wherein a spacing between two of the pixel electrodes adjacent to each other and arranged along the second direction is less than a width of the one of the scan lines.

* * * * *